United States Patent [19]

Joyce

[11] 4,092,765

[45] June 6, 1978

[54] MINIATURIZED HARNESSING DEVICE

[75] Inventor: Arthur W. Joyce, Framingham, Mass.

[73] Assignee: Dennison Manufacturing Company, Framingham, Mass.

[21] Appl. No.: 827,760

[22] Filed: Aug. 25, 1977

Related U.S. Application Data

[63] Continuation-in-part of Ser. No. 657,513, Feb. 12, 1976, abandoned.

[51] Int. Cl.[2] ..... B65D 63/10

[52] U.S. Cl. ..... 24/16 PB

[58] Field of Search ..... 24/206 A, 16 PB

[56] References Cited

U.S. PATENT DOCUMENTS

| | | | |
|---|---|---|---|
| 3,186,047 | 6/1965 | Schwester et al. | 24/16 PB |
| 3,224,056 | 12/1965 | Joffe | 24/16 PB |
| 3,486,201 | 12/1969 | Bourne | 24/16 PB |
| 3,590,442 | 7/1971 | Geisinger | 24/16 PB |
| 3,660,869 | 5/1972 | Caveney et al. | 24/16 PB |
| 3,855,669 | 12/1974 | Meyer | 24/16 PB |
| 3,924,299 | 12/1975 | McCormick | 24/16 PB |
| 3,967,345 | 7/1976 | Sumimoto | 24/16 PB |

FOREIGN PATENT DOCUMENTS

| | | | |
|---|---|---|---|
| 1,201,483 | 8/1970 | United Kingdom | 24/16 PB |

*Primary Examiner*—Henry S. Jaudon
*Attorney, Agent, or Firm*—George E. Kersey

[57] ABSTRACT

A miniaturized harnessing device formed by a locking head and an attached serrated strap. The head contains a guide channel for receiving the strap after encirclement of the items to be harnessed, and an internal locking tang. The end of the strap before the regular serrations has a serrated ramp, the length of which is longer than the interval between regular serrations, to ease the insertion of the strap into a small-scale harnessing device.

4 Claims, 3 Drawing Figures

MINIATURIZED HARNESSING DEVICE

This application is a Continuation-in-part of patent application No. 657.513, filed Feb. 12, 1976 now abandonded.

BACKGROUND OF THE INVENTION

This invention relates to the harnessing of items and more particularly to the harnessing of items using miniaturized devices.

The harnessing devices that are in common use are formed by a strap that is insertable into an attached and apertured head which contains an internal tang that engages the strap. When a harnessing device is small, difficulties are often encountered in inserting the end of the strap into the head. Even after the end has been inserted a significant resistance is often encountered until the tang reaches the first engagement member.

Accordingly it is an object of the invention to facilitate the harnessing of objects using harnessing devices. A related object is to facilitate the harnessing of objects using small scale harnessing devices.

Another object is to facilitate the insertion of straps into harnessing devices. A related object is to facilitate the insertion of straps into small scale harnessing devices.

Representative harnessing devices are disclosed in U.S. Pat. Nos. 3,816,878 (June 18, 1974); 3,766,608 (Oct. 23, 1973); 3,731,347 (May 8, 1973); 3,537,146 (Nov. 3, 1972); 3,660,869 (May 9, 1972); 3,654,669 (Apr. 11, 1972) and 3,588,962 (June 29, 1971); 3,186,047, June 1, 1962); 3,224,056 (Dec. 21, 1965) 3,486,201 (Dec. 30, 1969); 3,590,442 (July 6, 1971); 3,660,869 (May 9, 1972); 3,855,669 (Dec. 24, 1974); 3,924,299 (Dec. 9, 1975); 3,967,345 and British Pat. No. 1.201.483 (Aug. 5, 1970).

SUMMARY OF THE INVENTION

In accomplishing the foregoing and related objects, the invention provides a harnessing device in which the end of the strap inserted into a channel of a locking head is provided with a surface discontinuity extending from members of the strap engageable in the head over an interval greater than the distance between the members.

In accordance with one aspect of the invention the discontinuity extends towards the head from an end that is as thick as the unobstructed channel in the head.

In accordance with another aspect of the invention the discontinuity is in the form of a serrated ramp that can be planar or curved.

In accordance with a further aspect of the invention, the members engaged in the head are regular serrations and the ramp is about the length of two regular serrations, and has an angle of inclination with respect to the strap of between about 10 and 30°.

In accordance with a still further aspect of the invention, the discontinuity at the end of the strap inserted into a channel of a locking head is serrated to further facilitate the entry of the strap into the channel, and also to reduce any tendency for the strap to slip from the head during insertion.

DESCRIPTION OF THE DRAWINGS

Other aspects of the invention will become apparent from a description of several illustrative embodiments, taken in conjunction with the drawings, in which.

DETAILED DESCRIPTION

Figure 1A:
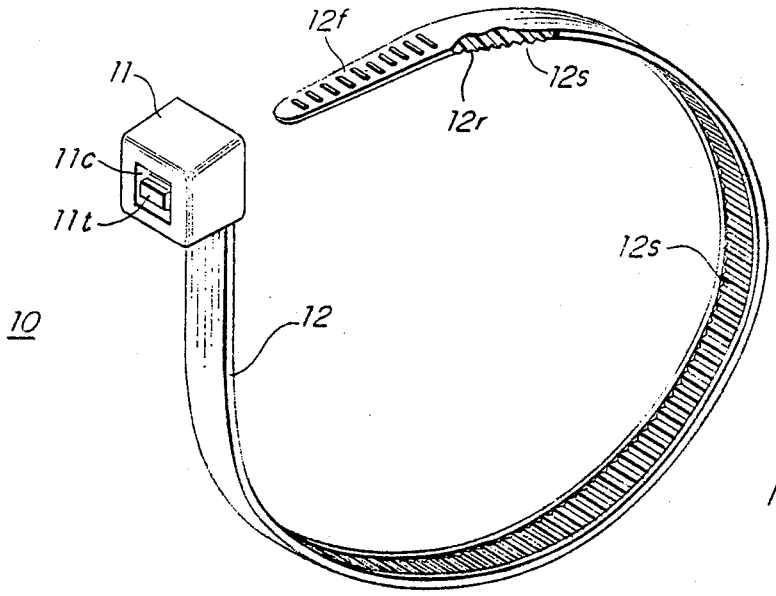
FIG. 1A is a perspective view of a miniaturized harnessing device in accordance with the invention.

As shown in FIG. 1A a miniaturized harnessing device 10 in accordance with the invention includes a head 11 and an attached strap 12. The free end **12*f* of the strap 12 is insertable into a channel 11*c* of the head 11 to engage a locking tang 11*t***, which may be stationary or deflectable.

Figure 1B:
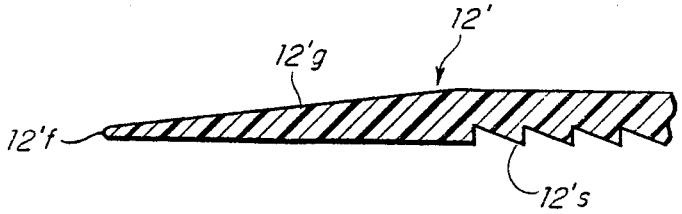
PRIOR ART FIG. 1B.
FIG. 1B is a sectional view of a portion of a prior art miniaturized harnessing device.

When harnessing devices of the type shown in FIG. 1A are miniaturized, it is important for their free ends **12*f* to be easily insertable into the channel 11*c* of the head 11. In attempting to meet this objective the prior art has provided a strap 12' of the type shown in FIG. 1B, with a region of gradual taper 12'*g* extending from the end 12'*f* to the beginning of serrations 12'*s*. When the end 12'*f* is inserted into a locking head (not shown) the tang encounters increasing resistance and the strap is difficult to harness. In addition the long taper 12'*g*** tends to have an adverse effect on the locking tang, which is typically of plastic material, such as nylon or polypropylene, and undergoes plastic deformation. On occasion, the temporary deformation prevents the locking tang from making proper engagement with the strap.

The difficulties encountered with the prior art have been overcome by modifying the end of the harnessing device strap as shown in FIG. 1A. Instead of having a gradual taper **12'*g* on the opposite side of the strap 12' from the serrations 12'*s*, the invention provides a shortened ramp 12*r* on the same side as the serrations 12*s*. It has been found that the pitch of the ramp should exceed the pitch of the serrations and is desirably approximately the length of two serrations. As a result of having a short ramp on the same side as the serrations, the strap is easily inserted, yet the locking tang 11t** is sufficiently gradually brought into contact with the serrations and is able to avoid detrimental plastic deformation.

Figure 2:
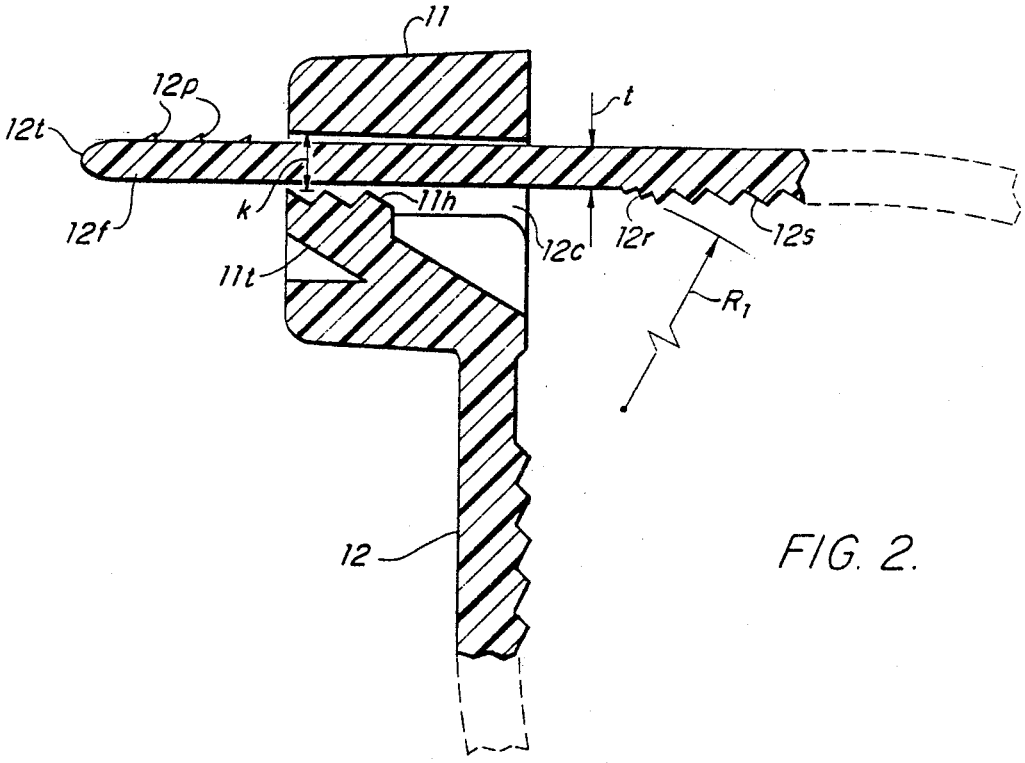
FIG. 2 is a partial cross-sectional view of a modified device of FIG. 1A- with its strap being inserted into its head.

As shown in FIG. 2 a strap 12 with a modified tip in accordance with the invention includes projections **12*p* that facilitate gripping of the end 12*f*. In addition the ramp 12*r* is serrated and has a radius of curvature $R_1$ which further tends to mitigate detrimental deformation of the locking tang 12*t*. The particular locking tang shown in FIG. 2 is deflectable and includes teeth 11*h* that mate with the serrations 12*s* of the strap. It is to be noted that the end of the strap 12 which extends between the tip 12*t* and the ramp 12*r*** has a substantially uniform thickness *t* which is essentially the same dimension as the maximum unobstructed height *h* of the channel **12*c*. As a result, the strap 12 is readily inserted into the channel 12*c* until the tang 11*t* encounters the ramp 12*r*. At that point the tang 11*t* begins to be gradually deflected out of the head 11 until the serrations of the tang engage corresponding serrations of the strap and ramp. The serrations of the ramp 12*r* reduce any tendency for the strap to slip from the head during insertion. Once the tang 11*t*** has been operated, further operation is readily achieved by pulling on the free end of the strap.

While various aspects of the invention have been set forth by the drawings and the specifications, it is to be understood that the foregoing detailed description is for illustration only and that various changes in parts, as well as the substitution of equivalent constituents for those shown and described, may be made without departing from the spirit and scope of the invention as set forth in the appended claims.

I claim:

1. A harnessing device comprising
a head having a guide channel therein,
a locking tang within said head,
and a strap having a plurality of members for sequentially engaging said locking tang when said strap is inserted into said channel,
the end of said strap having a serrated ramp in an outer surface extending from one of said members over an interval of curvature greater than the distance between said members, said ramp extending towards said head on said strap from an end thereof having a thickness substantially equal to the unobstructed height of the channel in said head.

2. Apparatus as defined in claim 1 wherein said ramp has an angle of inclination with respect to the surface of said strap in the range from about 10° to about 30°.

3. Apparatus as defined in claim 1 wherein the locking tang is deflectable.

4. Apparatus as defined in claim 1 wherein the strap is attached to the head at an angle with respect to the axis of insertion of the strap into the channel.

* * * * *